US006622851B1

(12) United States Patent
Wünscher

(10) Patent No.: US 6,622,851 B1
(45) Date of Patent: Sep. 23, 2003

(54) CONVEYOR SECTION ARRANGEMENT IN A FILLING STATION

(75) Inventor: Eduard Wünscher, Hart bei Graz (AT)

(73) Assignee: Knapp Logistik Automation GmbH (AT)

( * ) Notice: Subject to any disclaimer, the term of this patent is extended or adjusted under 35 U.S.C. 154(b) by 0 days.

(21) Appl. No.: 10/110,844

(22) PCT Filed: Oct. 6, 2000

(86) PCT No.: PCT/EP00/09794

§ 371 (c)(1),
(2), (4) Date: Jul. 10, 2002

(87) PCT Pub. No.: WO01/26972

PCT Pub. Date: Apr. 19, 2001

(30) Foreign Application Priority Data

Oct. 14, 1999 (DE) ..... 199 49 440

(51) Int. Cl.[7] ..... B65G 15/12

(52) U.S. Cl. ..... 198/626.2; 198/728; 198/734; 198/819; 198/834

(58) Field of Search ..... 198/834, 819, 198/728, 734, 708, 526, 626.1, 626.2, 155; 414/788; 141/36, 182, 189, 331, 332; 53/263

(56) References Cited

U.S. PATENT DOCUMENTS 4,534,156 A * 8/1985 Smith ..... 53/503
5,280,694 A * 1/1994 Malow ..... 53/475
5,833,046 A * 11/1998 Smith et al. ..... 198/458
5,897,291 A * 4/1999 Gerwe et al. ..... 414/790.7
6,059,094 A * 5/2000 Swantstrom, Jr . et al. ..... 198/735.4
6,128,886 A * 10/2000 Johnson, Jr. et al. ..... 53/445
6,231,299 B1 * 5/2001 Newsome et al. ..... 414/788.9

FOREIGN PATENT DOCUMENTS

DE 1 120 978 * 12/1961 ..... 198/626.2
GB 2 263 263 A * 7/1993 ..... 198/626.2

* cited by examiner

*Primary Examiner*—Douglas Hess
(74) *Attorney, Agent, or Firm*—McGlew and Tuttle, P.C.

(57) ABSTRACT

An arrangement (1) of a conveyor section (2) is provided for containers (10, 11, 12) that are conveyed on said conveyor section and that are in a filling position. The containers are to be filled with items (3) or with a bulk material in a filling station (4) by means of a filling funnel (5). The conveyor section (2) is provided on at least one side immediately before, in and after the filling station (4) with a continuous toothed belt or a chain belt (6) and with a pertaining intermitting actuator (7) and spaced apart container carrying plates (8). The plates can be positively engaged with the containers (10, 11, 12) that are open towards the top and that arrive on the conveyor section (2). The plates supply the containers to the filling position one by one and return the containers once they are filled from the filling position to the conveying section (2), preferably in an accelerated clocked manner and optionally at the outlet thereof. The carrying plates (8) that are in the filling position, that adjoin and the extend transversely to the direction of conveyance (F) configure a filling funnel wall between the filling funnel (5) and a container to be filled.

20 Claims, 6 Drawing Sheets

CONVEYOR SECTION ARRANGEMENT IN A FILLING STATION

FIELD OF THE INVENTION

The present invention pertains to an arrangement of a conveying track for containers that are conveyed on the conveying track, are to be filled with articles or bulk material in a filling station via a filling hopper and are located in the filling position, and especially to the part of an automatic commissioning transfer station that feeds the shipping containers to the filling station, positions same under the filling or transfer hopper for the duration of the transfer of the articles or product and subsequently removes them from the filling station.

BACKGROUND OF THE INVENTION

According to the state of the art, the containers are moved by means of a continuously running conveyor belt in the area of the automatic commissioning transfer unit. The separation of the arriving containers is brought about by a clamping device, which is arranged in front of the transfer station, grasps the respective frontmost container and allows it to move forward only shortly before the filling station becomes free. A second clamping device, which grasps the arriving container and holds same in the correct position until the conclusion of the filling, is located on both sides of the conveyor belt directly below the filling or transfer hopper arranged downstream of the first clamping device. The filled container is subsequently released, carried by the continuously driven conveyor belt in a frictionally engaged manner and is removed from the transfer area. The container change time and thus in many cases the throughput capacity of the entire commissioning unit thus depend on the velocity at which the containers are moved forward cyclically on the conveyor belt in a frictionally engaged manner. It is thus also ensured that containers located in the filling position, especially containers of different heights, are also filled satisfactorily with articles or bulk material, without articles dropping by the side in some cases. Articles falling by the side, which are sometimes expensive, usually break. As a rule, at least the operation of the filling station must be interrupted and the disturbance must be eliminated.

SUMMARY AND OBJECTS OF THE INVENTION

The object of the present invention is to create an arrangement of the above-mentioned type, which makes possible the satisfactory and effective filling of an exactly positioned container located in the filling position with simple means and optionally also permits a more rapid cyclic forward movement of the containers in the area of the filling station.

According to the invention, an arrangement is provided of a conveying track for containers. The containers are being conveyed on the conveying track, are to be filled with articles or with bulk material in a filling station via a filling hopper and are in the filling position. The essence of the present invention is that in the immediate area in front of, in and/or after the filling station, the conveying track has, on at least one side, a circulating toothed belt or chain drive with its own intermittent adjusting drive and container carrier plates located at spaced locations from one another. The toothed belt or chain drive can be brought into a positive-locking engagement with containers which are open at the top and arrive on the conveying track, and by which carrier plates the containers can be brought, in a separated manner, both into the filling position and removed from the filling position after filling in a cyclic and preferably accelerated manner. The containers may optionally be fed again into the conveying track on the output side, wherein adjacent carrier plates which are located in the filling position and extend at right angles to the direction of conveying form a filling shaft wall between the filling hopper and a container to be filled.

In an advantageous embodiment variant, six carrier plates are preferably provided, which are fastened, especially suspended in the circulating toothed belt or chain drive at equally spaced locations, wherein the distance corresponds to the width of the container in the direction of conveying.

The carrier plates are especially thin-walled spring steel plates which are stable in themselves, preferably with a thickness of approx. 0.7 mm.

The carrier plates have slots, especially on the top side, preferably in the vertical direction, which increase the elasticity and generate a spring effect when an obstacle is indeed located in the path of movement and is then overcome.

It is especially advantageous for two identical toothed belt or chain drives with vertical axes as well as with upper strand and lower strand to be provided on both sides of the conveying track, where the said toothed belt or chain drives are of a mirror symmetrical design, wherein the carrier plates are about half as wide as the width of the container at right angles to the direction of conveying and both drives are driven, especially in a cyclic manner, by a common drive motor.

In an especially advantageous variant of the present invention, the toothed belt or chain drive is provided with a stationary vertical container guide wall in the direction of conveying, which is arranged especially between the upper and lower strands of the toothed belt or chain drive, wherein the container guide wall forms, optionally together with the upper strand, a filling shaft wall in the direction of conveying in the area of the filling opening.

The filling hopper itself may be designed as a buffer hopper or be provided with a separate buffer hopper, which contains a horizontal slide, which closes the filling opening and can be opened, wherein the horizontal slide, which preferably has a two-part design, opens only when a container is positioned in the filling position and is otherwise closed.

In particular, an emergency means is provided for introducing and removing the containers to be filled in a cyclic manner especially in case of failure of the operation of the toothed belt or chain drive.

The emergency means comprises on each side two lateral stoppers, by which containers running through the filling station on a continuously driven conveyor belt can be positioned in the filling position as well as in the waiting position located in front of the filling position by lateral friction engagement and released.

The sensor mechanism of the adjusting drive of the toothed belt or chain drive or toothed belt or chain drives as well as of the emergency means that is optionally present comprises especially five photoelectric cells, an inductive transducer and a scanner, wherein an additional stopper for separating the containers, which can be put into the path of movement of the containers being delivered or can release the path of movement of the containers being delivered, is provided in the conveying track on the input side of the filling station.

The entire unit may be arranged such that a single continuous conveying track is provided in front of, in and after the filling station, preferably as a belt conveyor or belt drive.

The conveying track may be interrupted in the area of the circulating toothed belt or chain drive and have a separate belt conveyor or belt drive with a separate drive.

The input-side conveying track located in front of the toothed belt or chain drive may be a conveyor belt, an accumulating roller conveyor without impact pressure or a driving roller conveyor with impact pressure.

The belt conveyor or belt drive may also have a stationary upper sliding surface in the area of the filling position, and the belt conveyor or belt drive may be offset downward in parallel via deflecting rollers in the area of the sliding surface.

The change of containers can be carried out by the present invention at a filling station preferably in an accelerated manner and especially accurately. The container to be filled is positioned exactly in the filling position and is filled without problems. The containers (cardboard boxes or the like) are moved forward in a cyclic manner very rapidly by a flat carrier under a transfer hopper (buffer hopper) in a positive-locking manner. The essence of the present invention is especially that when the products fall off from the transfer hopper into the container located underneath, which may additionally have varying heights (h or h'), no products can fall by the side. This is achieved according to the present invention by the shaft-like design of the opening of the transfer hopper up to the opening of the container, regardless of the height of a container. The opening is formed at right angles to the direction of conveying by the carrier plates or carrier aprons themselves, which determine the overall opening together with lateral baffle plates.

To prevent any products from falling by the side, the loading gauge of the so-called indexer is adjusted to the containers or cardboard boxes such that when viewing, e.g., in the front and behind in the direction of conveying, there is only an overall clearance of about 6 mm. The container or cardboard box consequently has only an overall clearance of about 6 mm in the direction of conveying. Due to the fact that the other products have a minimum size of about 12 mm to 15 mm, no product can fall by the side during filling.

In particular, the indexer has a toothed belt or chain drive on the left and right on the side of the container with vertical axes. This drive is driven by a single motor operator or adjusting drive by means of a common chain or a common double-toothed belt. In particular, six carrier plates, made preferably of spring steel, which represent approximately half the width of the container, are mounted at each toothed belt or chain drive. Due to the fact that the left-hand and right-hand toothed belt or chain drives are synchronized by means of a drive, it is possible for the carrier plates to move toward the container under the transfer site in a cyclic manner. In combination with the transfer site and the container, the carrier plates or aprons form at this moment a shaft, which is so narrow that even the smallest products are unable to fall by the side.

Furthermore, an emergency property is also provided. Should the lateral drive or the carrier plates no longer be able to function, it is possible to continue the movement at least in an emergency operation by removing the carrier plates located in the passage (preferably a total of four here-in case of six carrier plates arranged at equally spaced locations on each side) and by the sensor actuation of two stoppers, which fix the container in the transfer position or in the waiting position.

The sensor mechanism comprises five photoelectric cells, an inductive transducer and a scanner. Furthermore, there is a stopper in order to let the containers enter one by one. In addition, there are two more stoppers, which determine the position of the containers in case of a possible emergency operation, in which some of the carrier plates are removed and are no longer functional.

With respect to the state of the art discussed in the introduction, the frictionally engaged carrying of the containers is replaced by the present invention with a positive-locking carrying, namely, by means of the carrier plates provided according to the present invention, which can engage the containers of the conveying track which are to be moved cyclically into the filling station.

On the input side of the filling station, the carrier plates grasp behind the containers and optionally permit a high acceleration of the containers from the standing position, doing so by means of a carrier plate engaging the rear side of the container, which rear side faces away from the direction of conveying. Since the positioning of the containers takes place in a positive locking manner and not by clamping the containers, as according to the state of the art, it is possible to use according to the present invention not only comparatively stable containers, e.g., containers made of plastic, but also containers made of more sensitive material, e.g., pasteboard.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
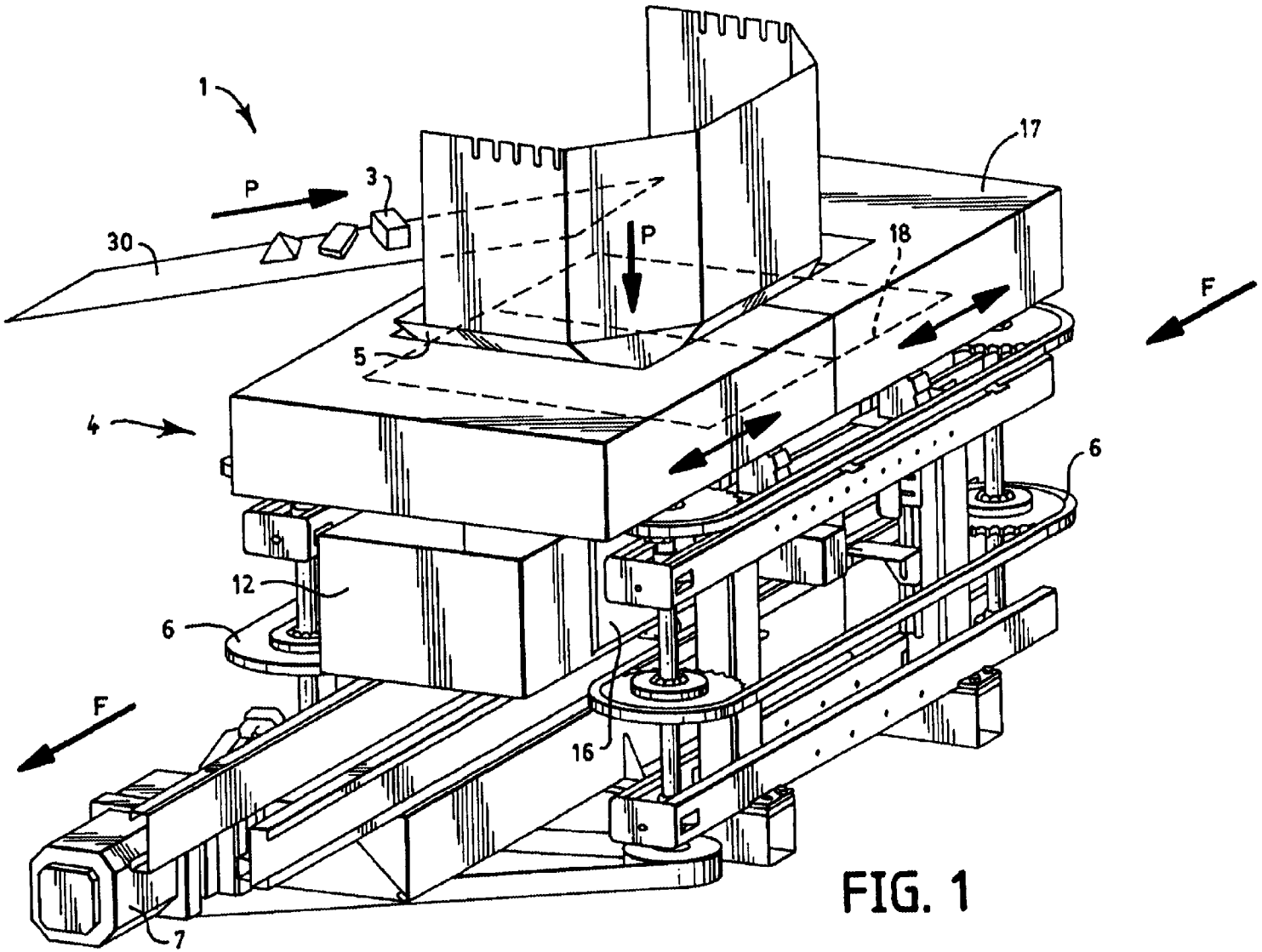
FIG. 1 is a schematic perspective view of an arrangement of a conveying track of a commissioning unit in the area of a filling station, in which open containers being conveyed on the conveying track are filled with articles or products and are subsequently fed to a shipping station, wherein a double toothed belt drive each with vertical axes with carrier plates, which are driven by a common adjusting drive by means of a toothed belt, are provided laterally from the passage of the containers and laterally from the conveying track.
Figure 2:
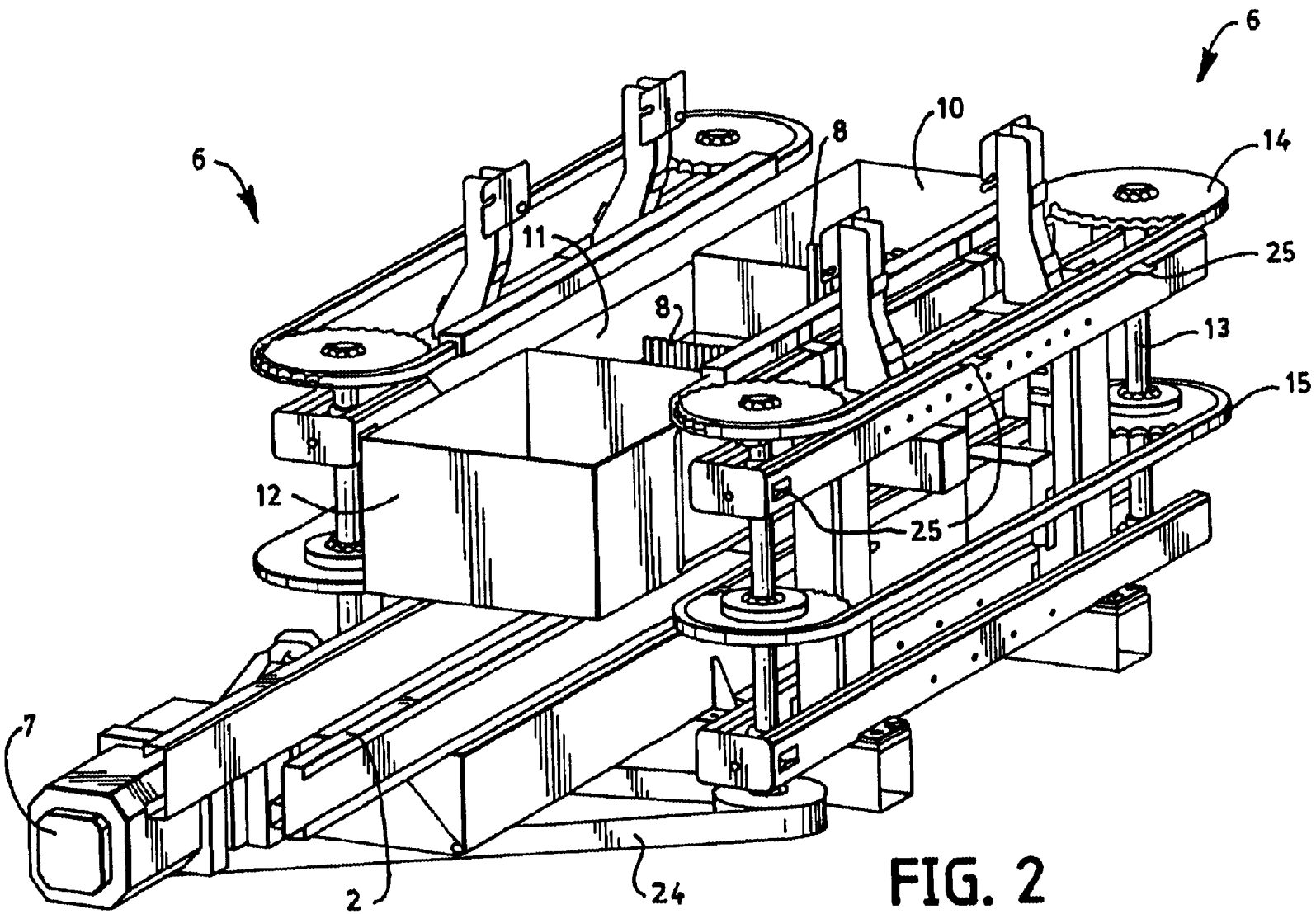
FIG. 2 is a schematic perspective view of the arrangement according to FIG. 1, wherein the filling hopper and the buffer hopper are omitted.
Figure 3:
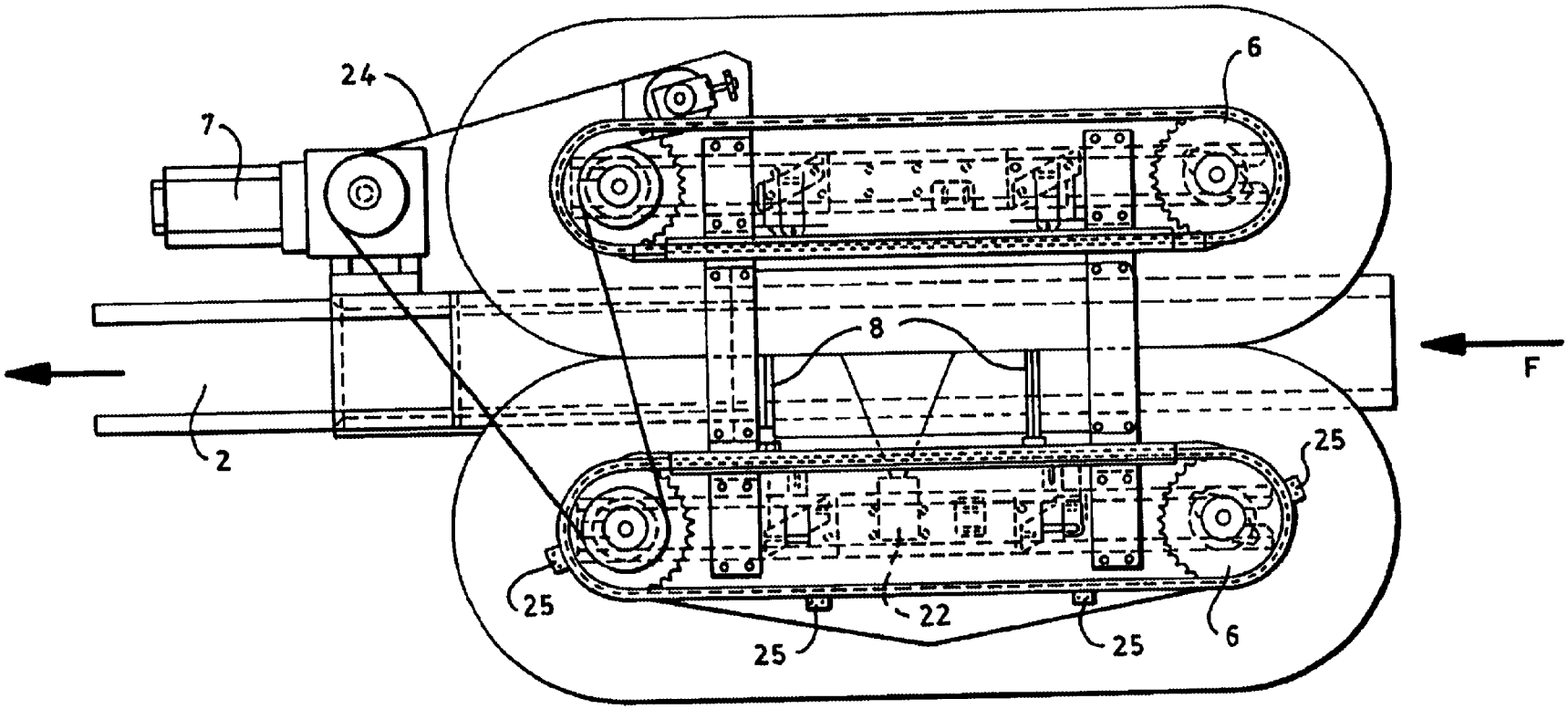
FIG. 3 is a schematic top view of the arrangement according to FIG. 2 with the omission of the containers.
Figure 4:
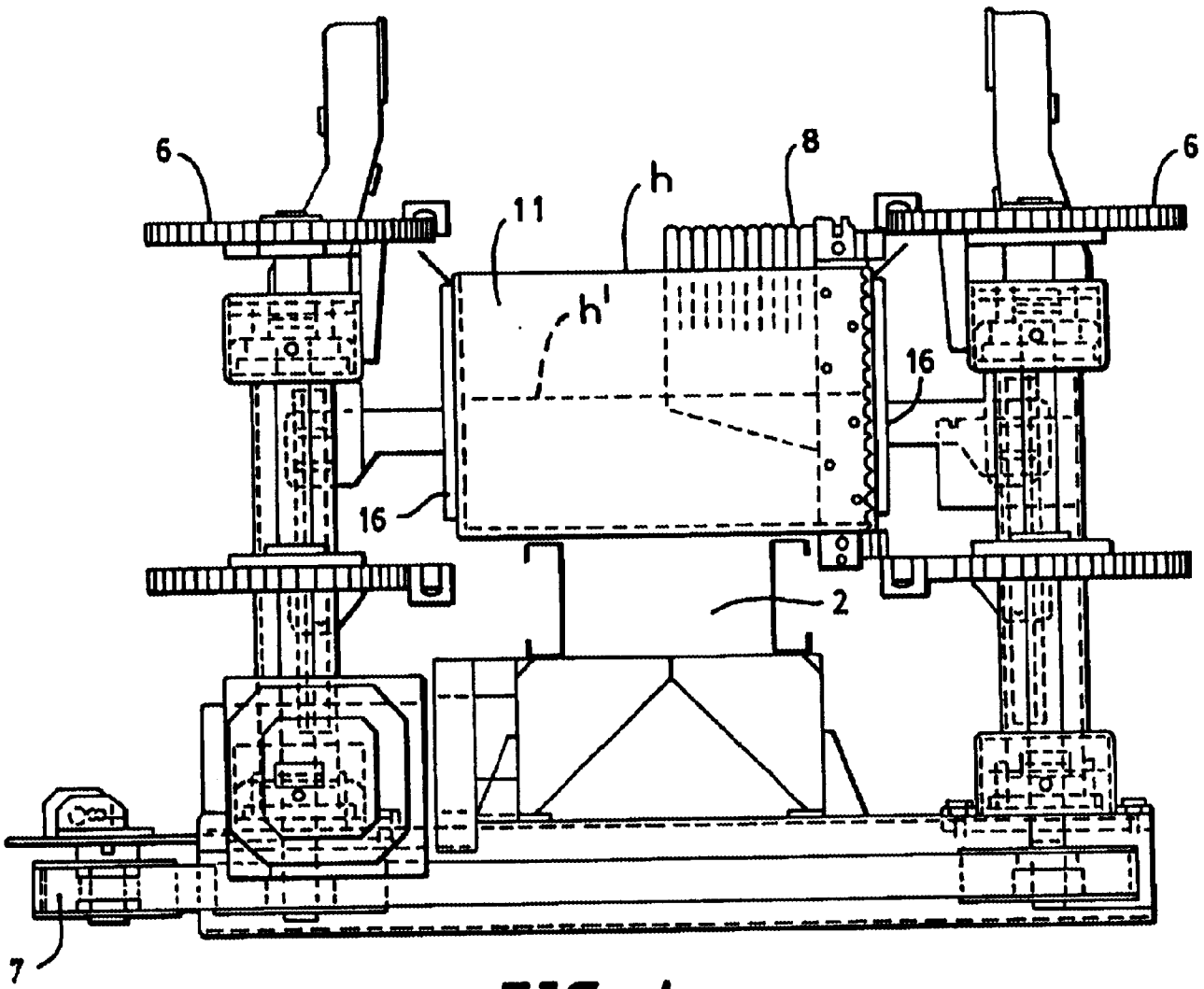
FIG. 4 is a schematic front view of the arrangement according to FIG. 2, wherein the carrier plate of the left-hand double toothed belt drive is omitted on the left-hand side.

Referring to the drawings in particular, the commissioning unit with, e.g., high-speed automatic turning units, bay storage areas for articles, bay storage and retrieval units, etc., which is of no specific interest here, also comprises an arrangement 1 of a conveying track 2 for (shipping) containers or collective boxes from a container reserve station to a container shipping station with a filling station 4 arranged between them. At the filling station commissioned articles 3 or bulk material is filled by means of a filling hopper 5 into a container 10, 11, 12. The container 10, 11, 12 is open at the top and is being conveyed on the conveying track 2 and is arranged under the filling hopper, as can be seen especially in FIG. 1.

The articles 3 or the bulk material are fed to the filling hopper 5 by means of an oblique central conveyor belt 30 in the direction of arrow P.

The conveying track 2, which may be, in principle, e.g., a continuous conveyor belt, a driving roller conveyor or an accumulating roller conveyor, has, in the immediate area in front of, in or after the filling station 4, on the right and left, i.e., on both sides of the conveyor belt or the like, a toothed belt or chain drive 6 with a common dynamic drive in the form of an intermittent adjusting drive 7, which ensures the slip-free, accelerated cyclic forward movement of one or more containers, which are located in the immediate area of the filling station 4.

In particular, each of the lateral toothed belt or chain drives 6 has container carrier plates 8 arranged at equally spaced locations from one another, six such carrier plates in the exemplary embodiment. By this arrangement the containers 10, 11, 12 arriving on the conveying track 2, which are open at the top, are moved cyclically both into the filling position and are removed from the filling position after filling preferably in an accelerated and cyclic manner and are optionally fed again into the conveying track 2 on the output side.

The circulating toothed belt or chain drive 6 on both broad sides of the conveying track has an axially symmetrical design in relation to the conveying track such that associated carrier plates 8 are located on each side in the direction of conveying F of the containers at equal height or length.

In front of the toothed belt or chain drive 6, the conveying track 2 has a stopper 21, which can be placed into the path of movement of the containers being conveyed and can release the path of movement of the containers being conveyed.

The conveying track 2 is arranged such that a filling shaft wall is formed between the filling hopper 5 and a container to be filled especially by adjacent carrier plates 8 that are located in the filling position and extend at right angles to the direction of conveying F.

The six carrier plates 8 are especially suspended in the corresponding circulating toothed drive at equally spaced locations, the distance corresponding to the width of the container in the direction of conveying F.

Figure 6:
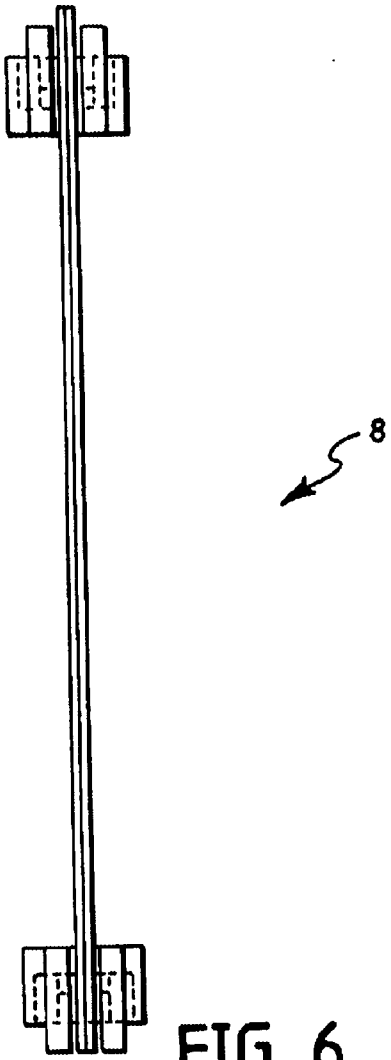
FIG. 6 is a front view of the carrier plate according to FIG. 5.
Figure 5:
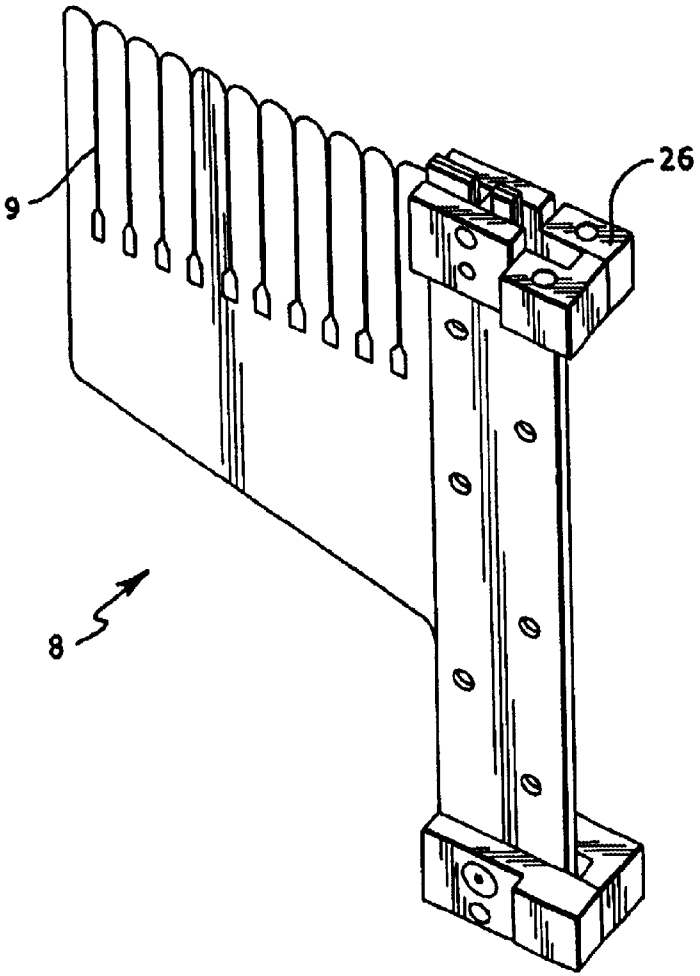
FIG. 5 is a perspective view obliquely from the top of a carrier plate.

The carrier plates 8 are thin-walled spring steel plates and have slots 9 on the top side in the vertical direction. The carrier plate 8 is specifically shown in FIGS. 5 and 6. It has a vertical holding strap with a top-side bracket 26 for fastening to a toothed belt fastening site 25, especially on the upper strand 14 of the corresponding toothed belt drive 6, while the vertical holding strap is likewise fastened or laterally supported on the underside at the lower strand 15 in the exactly vertical orientation of a carrier plate 8.

Consequently, two identical toothed belt drives 6, which have a mirror symmetrical design and are arranged opposite each other, with vertical axes 13 as well as with upper and lower strands 14, 15, are provided on both sides of the conveying track 2, and the carrier plates 8 are about half as wide as the width of the container at right angles to the direction of conveying F, and both drives 6 are driven, especially in a cyclic manner, by a common adjusting drive 7.

Each toothed belt drive 6 is provided with a stationary vertical container guide wall 16 in the direction of conveying F, which is arranged especially between the upper and lower strands 14, 15 of the toothed belt drive 6, wherein the container guide wall 16 forms, optionally together with the upper strand 14, a filling shaft wall in the direction of conveying F in the area of the filling opening.

The filling hopper 5 may be designed as a buffer hopper or be provided with a separate buffer hopper, which contains a horizontal slide 18 that closes the filling opening and can be opened, wherein the horizontal slide of two-part design is opened only when a container 11 is in the filling position and is otherwise closed.

Furthermore, an emergency means is provided for introducing and removing the containers 10, 11, 12 to be filled in a cyclic manner in case of failure of the operation of the toothed belt drive 6.

The emergency means comprises on each side two lateral stoppers 19, 20, by which containers 10, 11, 12 moving through the filling station 4 on a continuously driven conveyor belt can be positioned in the filling position as well as in waiting position located in front of the filling position preferably by lateral frictional engagement and released.

Figure 7:
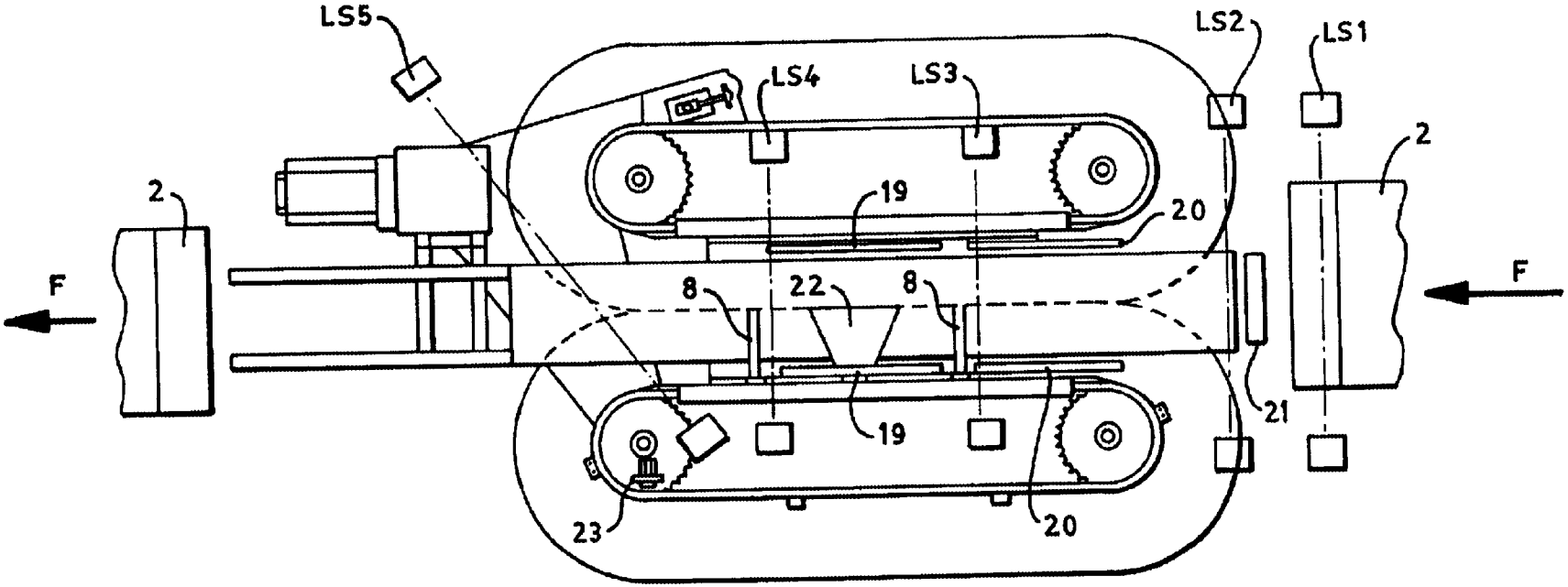
FIG. 7 is a top view of the arrangement according to FIGS. 1 through 4 with the input-side and output-side connection of a conveying track as well as with the view of photoelectric cells.

The sensor mechanism of the adjusting drive 7 of the toothed belt drive 6 comprises five photoelectric cells LS1, LS2, LS3, LS4, LS5, an inductive transducer 23 and a scanner 22 according to FIG. 7, and the stopper 21 in the conveying track on the input side of the filling station ensures the separation of the containers 10, 11, 12.

Consequently, a so-called indexer with a built-up buffer hopper is provided according to FIG. 1. The central belt or the ascending belt of the central belt conveys from the left a heap of product, which is transferred into the cardboard boxes or into the containers at the transfer site. The function of the buffer hopper specifically calls for a two-part slide here, where the two halves of the slide are opened as soon as the cardboard box is positioned underneath. The advantage is that the hopper can already be filled via the slide during the positioning operation. Once the cardboard box is positioned, the slide goes up, and the products drop downward into the positioned container.

Another advantage of the indexer is that a distance, e.g., 100 mm, can be maintained between the halves of the slide and the top edge of the cardboard box even if the cardboard boxes or the containers are of equal height, so that products jutting out are not clamped during the closing of the halves of the slide.

The procedure or the mode of operation of the indexer is as follows.

The indexer is completely empty. The cardboard box moves to the photoelectric eye LS1 and passes through to the carrier plate 8, which is stationary at this point in time, on the right, according to FIG. 7. The carrier plate is then moved through cyclically into the position of the carrier plate 8 shown in FIG. 7, on the left, i.e., into the filling position, the container is carried in a positive-locking manner, and scanned at the same time. A second following container now moves through the photoelectric cells LS1 and LS2 back again to the carrier plate 8, on the right, and actuates the photoelectric cell LS3. If a third container is arriving, the photoelectric cell LS1 must activate the stopper 21 due to the fact that the photoelectric cells LS3 and LS4 are activated, and the container stops in front of the indexer. The photoelectric cell LS2 is only a control photoelectric cell. Should the stopper be run over for any reason and the photoelectric cell LS2 activated, the indexer goes over to disturbance mode ("separation of the containers"), because a "crash" would otherwise occur in case of a further movement of the container over the indexer. After the filling operation on the container in the filling position, the indexer moves cyclically forward by one carrier position. The container of the waiting position thus moves into the filling position. The filled container moves out and is removed to a packaging station on the output-side conveying track 2.

The photoelectric cell LS5 is also a control photoelectric cell, which controls the leaving container. The indexer may index only when this area has been released. The inductive transducer detects the carrier plates directly, and the following function is assumed: Due to the fact that the drive is driven via a motor actuator and a corresponding ramp, especially an asymmetric sine square ramp.

The inductive transducer is directed directly toward the carrier plate, but this is now really related to the beginning and end, i.e., referencing is performed once at the time of each cyclic forward movement, and the motor operator seeks to reach the position of the carrier plates based on its stored ramp and counting cycles.

Control engineering procedure in emergency operation:

The indexer is out of operation. Corresponding carrier plates in the passage must be removed in order to guarantee free passage. In terms of control, everything is as in normal operation. The photoelectric cell LS3 and the photoelectric cell LS4 now also trigger photoelectric cells for the stoppers. The containers are passed on in a frictionally engaged manner on the corresponding continuous conveyor belt. The indexer with its inductive transducer is completely out of operation. The throughput is correspondingly reduced because the cyclic movement through the system cannot be performed in a positive-locking manner and with a high acceleration.

While a specific embodiment of the invention has been shown and described in detail to illustrate the application of the principles of the invention, it will be understood that the invention may be embodied otherwise without departing from such principles.

I claim:

1. An arrangement of a conveying track for containers, which are being conveyed on the conveying track, are to be filled with articles or bulk material in a filling station via a filling hopper in a filling position, the arrangement comprising:

a circulating toothed belt or chain drive associated with at least one side of the conveying track, said circulating toothed belt or chain drive being in the immediate area in front of, in and/or after the filling station;

an intermittent adjusting drive connected to said circulating toothed belt or chain drive;

container carrier plates arranged at spaced locations from one another, said carrier plates being brought into positive-locking engagement with the containers which arrive on the conveying track and are open at the top, said carrier plates for moving the containers in a separated manner both into the filling position and, after filling, removing the containers from the filling position in a cyclic accelerated manner for movement out of the filling station and feeding back into the conveying track on an output side, wherein said adjacent carrier plates, which are located in the filling position and extend at right angles to the direction of conveying, form a filling shaft wall between the filling hopper and a container to be filled.

2. An arrangement in accordance with claim 1, wherein said container carrier plates comprise six carrier plates provided and fastened in a suspended manner in said circulating toothed belt or chain drive at equally spaced locations, wherein the distance corresponds to half the width of the container in the direction of conveying.

3. An arrangement in accordance with claim 1, wherein said carrier plates are thin-walled spring steel plates.

4. An arrangement in accordance with claim 1, wherein said carrier plates have slots on a top side, said slots extending substantially in a vertical direction.

5. An arrangement in accordance with claim 1, further comprising a substantially identical toothed belt or chain drive of a substantially mirror symmetrical design to said circulating toothed belt or chain drive, said substantially identical toothed belt or chain drives and said circulating toothed belt or chain drive being located opposite each other, with vertical axes as well as with said upper and lower strands being provided on both sides of the conveying track, wherein the carrier plates are about half as wide as the width of the container at right angles to the direction of conveying and both said drives are driven in a cyclic manner by said adjusting drive acting in common.

6. An arrangement in accordance with claim 1, wherein said toothed belt or chain drive is provided with a stationary vertical container guide wall in a direction of conveying, said stationary vertical container guide wall being arranged especially between upper and lower strands of said toothed belt or chain drive, wherein the container guide wall forms a filling shaft wall in a direction of conveying in the area of the filling opening together with an upper strand.

7. An arrangement in accordance with claim 1, wherein the filing hopper is one of a buffer hopper or is provided with a separate buffer hopper containing a horizontal slide for closing and opening the filling opening, wherein the horizontal slide, is of a two-part design and is opened only when a container is in the filling position and is otherwise closed.

8. An arrangement in accordance with claim 1, wherein an emergency means is provided for cyclically introducing and removing the containers to be filled, in case of failure of the operation of the toothed belt or chain drive.

9. An arrangement in accordance with claim 8, wherein the emergency means comprises two lateral stoppers, one on each side for positioning the containers moving through the filling station on a continuously driven conveyor belt in the filling position as well as in the waiting position located in front of the filling position preferably by lateral frictional engagement and released.

10. An arrangement in accordance with claim 8, further comprising a sensor mechanism associated with the adjusting drives and said emergency means, said sensor mechanism comprising five photoelectric cells, an inductive transducer, and a scanner, and an additional stopper, which can be placed into the path of movement of the containers being conveyed and can release the path of movement of the containers being conveyed, said additional stopper being provided in the conveying track on an input side of the filling station for separating the containers.

11. An arrangement in accordance with claim 1, wherein a single continuous conveying track is provided in front of, in and after the filling station as a belt conveyor or belt drive.

12. An arrangement in accordance with claim 11, wherein the conveying track is interrupted in the area of the circulating toothed belt or chain drive and has a separate belt conveyor or belt drive with a separate drive.

13. An arrangement in accordance with claim 12, wherein the input-side conveying track located in front of the toothed belt or chain drive is a conveyor belt, an accumulating roller conveyor without impact pressure or a driving roller conveyor with impact pressure.

14. An arrangement in accordance with claim 12, wherein the belt conveyor or belt drive has a stationary upper sliding surface in the area of the filling position, and the belt conveyor or belt drive is offset downward in parallel via deflecting rollers in the area of the sliding surface.

15. An arrangement in accordance with claim 1, wherein said container carrier plates are suspended from said circulating toothed belt or chain drive at equally spaced locations, the carrier plates comprising thin-walled spring steel plates.

16. An arrangement in accordance with claim 1, further comprising a sensor mechanism associated with the adjusting drives, said sensor mechanism comprising five photoelectric cells, an inductive transducer, and a scanner, and an additional stopper, which can be placed into the path of movement of the containers being conveyed and can release the path of movement of the containers being conveyed, said additional stopper being provided in the conveying track on an input side of the filling station for separating the containers.

17. An arrangement in accordance with claim 1, further comprising a substantially identical toothed belt or chain drive of a substantially mirror symmetrical design to said circulating toothed belt or chain drive, said substantially identical toothed belt or chain drives and said circulating toothed belt or chain drive being located opposite each other, with vertical axes as well as with said upper and lower strands being provided on both sides of the conveying track, wherein the carrier plates are about half as wide as the width of the container at right angles to the direction of conveying and both said drives are driven in a cyclic manner by said adjusting drive acting in common.

18. An arrangement for containers to be filled with articles or bulk material in a filling station with a filling position, the arrangement comprising:

a conveyor for conveying the containers to a location adjacent to the filing station and removing the containers from adjacent to the filing position;

filling hopper at the filing position;

a circulating toothed belt or chain drive associated with at least one side of the conveyor, said circulating toothed belt or chain drive being in the immediate area in front of, in and/or after the filling station;

an intermittent adjusting drive connected to said circulating toothed belt or chain drive;

container carrier plates arranged at spaced locations from one another along said circulating toothed belt or chain drive, said carrier plates being brought into positive engagement with the containers which arrive on the conveying track and are open at the top, said carrier plates for moving the containers in a separated manner both into the filling position and, after filling, removing the containers from the filling position in a cyclic accelerated manner for movement out of the filling station and feeding back into the conveying track on an output side, wherein said adjacent carrier plates which are located in the filling position and extend at right angles to the direction of conveying to form a filling shaft wall between the filling hopper and a container to be filled.

19. An arrangement in accordance with claim 18, wherein said carrier plates are thin-walled spring steel plates and have slots on a top side, said slots extending substantially in a vertical direction.

20. An arrangement in accordance with claim 18, wherein said container carrier plates are fastened in a suspended manner to said circulating toothed belt or chain drive at equally spaced locations, wherein the distance corresponds to half the width of the container in the direction of conveying.

* * * * *